US007074460B2

(12) United States Patent
Poirier et al.

(10) Patent No.: US 7,074,460 B2
(45) Date of Patent: Jul. 11, 2006

(54) METHOD FOR TREATING THE SURFACE OF A PART AND RESULTING PART

(75) Inventors: Laurent Poirier, Maisons-Lafitte (FR); Jean-Paul Lebrun, Bougival (FR); Bernard Delmas, Clichy (FR)

(73) Assignee: Nitruvid, Argenteuil (FR)

( * ) Notice: Subject to any disclaimer, the term of this patent is extended or adjusted under 35 U.S.C. 154(b) by 513 days.

(21) Appl. No.: 10/240,331

(22) PCT Filed: Apr. 18, 2001

(86) PCT No.: PCT/FR01/01192

§ 371 (c)(1),
(2), (4) Date: Feb. 21, 2003

(87) PCT Pub. No.: WO01/79579

PCT Pub. Date: Oct. 25, 2001

(65) Prior Publication Data

US 2004/0045636 A1 Mar. 11, 2004

(30) Foreign Application Priority Data

Apr. 19, 2000 (FR) ..... 00 05058

(51) Int. Cl.
*B05D 3/14* (2006.01)

(52) U.S. Cl. ..... 427/562; 148/206; 148/222

(58) Field of Classification Search ..... 148/217, 148/218, 222; 427/562–564
See application file for complete search history.

(56) References Cited

U.S. PATENT DOCUMENTS

| | | | | |
|---|---|---|---|---|
| 3,968,957 | A * | 7/1976 | Asai et al. | 266/257 |
| 5,794,761 | A | 8/1998 | Renaud et al. | |
| 5,989,363 | A * | 11/1999 | Georges | 148/222 |

FOREIGN PATENT DOCUMENTS

| | | | |
|---|---|---|---|
| DE | 41 24 600 | A1 | 1/1994 |
| EP | 801 142 | A2 | 10/1997 |
| GB | 2 261 227 | A | 5/1993 |
| JP | 2000072415 | A * | 3/2000 |
| WO | WO 99 04056 | A1 | 1/1999 |
| WO | WO 00 25170 | A1 | 5/2000 |

* cited by examiner

*Primary Examiner*—Timothy Meeks
*Assistant Examiner*—Howard Abramowitz
(74) *Attorney, Agent, or Firm*—Sughrue Mion, PLLC

(57) ABSTRACT

A surface treatment method in which a surface of a part (7) is contacted with at least one activated species. The activated species is obtained by activating a gaseous medium containing at least two of the following elements: carbon, nitrogen, boron and oxygen. Preferably, the activated species is a neutral excited CN species. The activated species brings at least one interstitial element to the metal part (7) surface which is borne and maintained at a temperature enabling the interstitial element to be diffused into a surface layer of the metal part (7).

17 Claims, 1 Drawing Sheet

METHOD FOR TREATING THE SURFACE OF A PART AND RESULTING PART

BACKGROUND OF THE INVENTION

The invention relates to a method for treating the surface of a part which consists in bringing at least one activated chemical species, such as an activated chemical species contained in a cold plasma, into contact with a surface of the part.

Methods are known for treating the surface of parts by bringing a surface of the part into contact with at least one activated chemical species contained in a cold plasma which may be generated, for example, by an electric discharge between an anode and a cathode, inside a chamber containing a gas and generally a gaseous mixture at a pressure lower than atmospheric pressure.

Plasma contains electrons and also activated species which themselves comprise ionised species and excited neutral species, that is to say, atoms or molecules, some of the electron shells of which are excited under the effect of the electric discharge. The hardening of steel parts by introducing interstitial elements into a surface layer of the steel may be mentioned as an example of the application of surface treatments that use chemical species activated, for example, by electric discharge. The interstitials normally used for hardening the steel are principally nitrogen, carbon and boron. The treatment consists in generating a plasma, for example by an electric discharge, in a gaseous medium containing the interstitial and in bringing the plasma containing activated species into contact with the surface of the part to be treated. The interstitial in the activated state is strongly reactive with respect to the surface of the part, so much so that it penetrates through the surface of the part. During treatment, the part is brought to a temperature which ensures diffusion of the interstitial in the surface layer of the part, to a depth which depends, in particular, on the temperature and the duration of the treatment.

Hardening treatments or, more generally, treatments aiming to modify the surface properties of parts, in particular steel parts, are carried out in this manner by the introduction and diffusion of interstitials in a surface layer of the part.

Normally, a discharge is produced between the part brought to a cathode potential and an anode which may be constituted, for example, by the wall or a portion of the chamber in which the treatment is carried out. In that case, the cold plasma is produced in situ, in the vicinity of the surface of the part to be treated, by electric discharge inside the gaseous medium filling the treatment chamber. The activated species, for example the ionised species or the excited neutral species, are formed in the vicinity of the surface of the part with which they react in order to ensure the provision of an element of the interstitial type.

Generally, the heating and the maintaining of the temperature of the part in order to ensure the diffusion of the interstitial are achieved by electric discharge. It is also possible to provide supplementary means for heating and for maintaining the temperature.

The plasma may also be generated, inside the chamber, by an electromagnetic wave generator, for example a microwave generator or a radio-frequency generator, those means generally requiring pressures of plasma-producing gaseous medium different from the pressures necessary when an electric discharge is used.

The plasma may also be generated in a plasma generator outside the treatment chamber and then transferred into the chamber containing the part to be treated which is heated and maintained at temperature inside the chamber.

In a case where the interstitial used to carry out the treatment is constituted by nitrogen, the gaseous mixture in which the plasma is formed contains nitrogen or a gaseous derivative of nitrogen, those compounds being generally diluted with hydrogen or a mixture of hydrogen and an inert gas, such as argon, or by any other non-reactive diluent mixture. An example of a gaseous mixture commonly used is the mixture $N_2+H_2$.

The plasma produced in such a gaseous mixture generally contains ionised species, such as, for example, $N^+$ and $N_2^+$ and also excited neutral species, such as, for example, N, $N_2$, NH and H.

It has generally been observed that excited neutral species exhibit good reactivity with respect to the metal surface subjected to the plasma and work efficiently towards the introduction of interstitials at the surface of the part.

In addition, it has been observed that, in the case of a transferred plasma or "post-discharge" plasma, the transfer time of the plasma into the chamber has to be very short in order to preserve reactive species in the plasma. It has also been observed, in the case of a transferred or "post-discharge" plasma, that it is difficult to obtain homogeneous gaseous flow in industrial charges.

In a case where the plasma is produced by an electric discharge, the electric discharge must be maintained in a state of abnormal luminescent discharge, that is to say, a state preceding a state of arc formation between the cathode and the anode.

In a case where the discharge is produced between the part constituting the cathode and a portion of the treatment chamber constituting the anode, there is a not inconsiderable risk that arcs which generate surface defects on the part to be treated will be formed.

In addition, the fact that the plasma is applied directly to the part may cause differences in heating between different portions of the part or from one part to another when a charge comprising a plurality of parts is treated inside the chamber. If some portions of the parts are overheated, when they are made of stainless steel, it is possible to form locally, in the layer enriched with interstitials, precipitates, for example of nitride, which substantially impair the corrosion resistance of the surface of the part.

The treatment temperature of the part, for example in the case of a hardening treatment by interstitial nitrogen or carbon carried out on parts made of steel and, more particularly, parts made of austenitic stainless steel, must be carefully regulated in order to control precisely the diffusion of the interstitials in the surface layer of the part.

Provided that a specific temperature, which is, for example, of the order of from 460° C. to 480° C., is not exceeded, in the case of an austenitic stainless steel, there is formed in the surface layer of the part a solid solution of carbon and/or nitrogen in the metal matrix of the steel, over a few micrometres up to a few tens of micrometres, this surface layer being extremely hard and resistant to wear and not impairing the corrosion resistance of the part.

At higher temperatures, a layer of a solid carbon and/or nitrogen solution is formed in the metal matrix and has the disadvantage of also comprising precipitates of nitrides and/or of carbides which substantially impair the corrosion resistance of the surface of the part.

It may be difficult to regulate precisely the temperature of a part, in all regions of the part, in particular when the part has large dimensions and/or extends over a great length, in a direction (bars or tubes). It is also difficult to regulate very precisely the temperature of each of the parts of a batch of parts which are being treated simultaneously in the treatment installation.

Furthermore, when a batch comprising numerous parts is being treated, it is necessary to arrange those parts on a support, which may be, for example, a cathode support of the treatment installation, prior to carrying out the treatment. This arrangement of parts requires the provision of means for supporting and positioning the parts on the cathode support in such a manner that the treated surface of the parts is completely exposed to the plasma which is formed in the electric discharge. Moreover, the arrangement of a large number of parts requires delicate handling and a performance time which may be long.

In the case of parts that have a complex shape and that comprise, for example, small cavities, it is difficult to carry out a treatment which is satisfactory in all portions of the parts.

Likewise, it is not possible to treat parts in the stacked state or to treat wound strips, owing to the fact that the surfaces that are not exposed to the gaseous medium in which the plasma is formed are not subjected to the treatment.

The methods for treating the surface of parts by activated species, generally excited neutral species and, to a lesser extent, ionised species, as currently implemented, therefore have some limitations, although such treatments have proved to be extremely effective in numerous applications.

SUMMARY OF THE INVENTION

The object of the invention is therefore to propose a method for treating the surface of a part, which consists in bringing at least one activated chemical species into contact with a surface of the part, the treatment being implemented in such a manner as to increase the reactivity of the activated chemical species used in proportions such that it is possible to treat parts having a complex shape and/or large dimensions, in large numbers positioned individually or in bulk, optionally inside containers, in a wound form or in the stacked state, with very good control of the treatment temperature.

To that end, the activated species is obtained by activating a gaseous medium containing at least two of the elements carbon, nitrogen, boron, oxygen, and the activated species comprises at least two of the elements carbon, nitrogen, boron and oxygen.

In a particularly advantageous manner, the treatment according to the invention is implemented by effecting the activation of a gaseous medium containing both carbon and nitrogen, for example, by an electric discharge, in order to obtain an excited neutral CN species which has a very high degree of reactivity when in contact with metal or non-metal surfaces, such as in the case of metal surfaces, surfaces of parts made of steel and more particularly of stainless steel.

In order to explain the invention clearly, a description will now be given, by way of example, with reference to the appended Figures, of the implementation of the method according to the invention for the surface hardening of parts by at least one of the interstitials carbon and nitrogen.

DETAILED DESCRIPTION OF THE INVENTION

Figure 1:
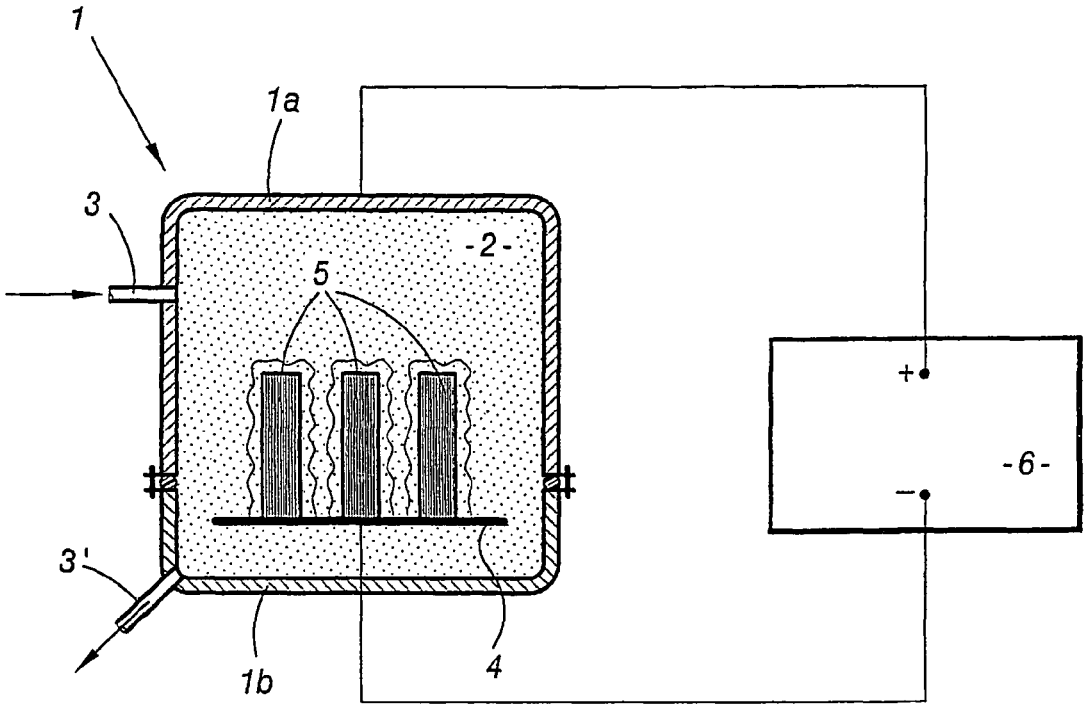
FIG. 1 is a diagrammatic view, in elevation and in section, of a treatment installation enabling the method of the invention to be implemented.

One of the basic aspects of the method according to the invention is that the activated species and the cold plasma comprising those species are produced in a gaseous medium containing at least two of the elements carbon, nitrogen, boron and oxygen, that is to say, at least two elements that can constitute interstitials in the metal matrix of a part to be treated.

In fact, such gaseous media can be obtained in various ways, for the implementation of the method of the invention.

The media which may be used in the case of a surface treatment using the interstitials nitrogen and carbon will be indicated below by way of example.

Gaseous Media Containing Both Nitrogen and Carbon:

The gaseous medium may be a gaseous mixture constituted by molecular gaseous nitrogen $N_2$ and/or a compound containing nitrogen, a compound containing carbon and, optionally, at least one diluent gas, such as hydrogen and/or an inert gas. The compound containing nitrogen may be, apart from molecular nitrogen, a gaseous derivative of nitrogen.

The compound containing carbon may be a hydrocarbon, for example an aliphatic or aromatic hydrocarbon, a cyclane, an alkene, an alkyne, an alkane, and especially methane.

The mixture of nitrogen and gaseous compounds containing carbon may be diluted with hydrogen or an inert gas, such as argon.

A typical mixture which may be used is the mixture $N_2+H_2+CH_4$.

The gaseous medium containing carbon and nitrogen may also be constituted by a compound, the molecule of which contains both carbon and nitrogen and which may be readily obtained in the gaseous state. Such a compound may be, for example, an amine. Such a gaseous compound may be diluted with hydrogen or an inert gas, such as argon, or by any other non-reactive diluent mixture.

The activation of the gaseous medium to obtain a cold plasma containing activated species, and in particular activated species containing both nitrogen and carbon, can be carried out in various manners which will be indicated below.

Activation of the Gaseous Medium Based on Nitrogen and Carbon:

The cold plasma can be generated by an electric discharge between an anode and a cathode inside a chamber containing the gaseous medium.

The electric discharge can be produced between the part to be treated and a portion of the treatment installation at an anode potential or, preferably, as will be explained hereinafter, between a container holding one or more parts to be treated and a portion of the treatment installation.

The cold plasma may also be generated by an electromagnetic-wave generator, for example a microwave generator or a radiofrequency generator.

The plasma may be generated inside or outside the chamber for treating the parts.

The activated species may also be generated in the gaseous mixture by other means.

In any case, the pressure of the gaseous medium in which the plasma or the activated species is(are) generated is adapted to the manner in which the activated species are generated.

For example, in the case of an electric discharge between a cathode and an anode inside the gaseous medium, the pressure of the gaseous medium, for example of a mixture of $N_2+H_2+CH_4$, is lower than atmospheric pressure and, for example, lower than 100 mbar.

In the case of the generation of a plasma by microwaves, the pressure of the gaseous medium is, for example, lower than 100 mbar.

In any case, the plasma is generated under conditions such that, among the activated species, that is to say, the ionised or excited neutral species, there is a notable proportion of species containing both nitrogen and carbon and, in particular, the excited neutral species of the CN form, the reactivities of which are particularly high.

If the gaseous medium contains oxygen, in addition to nitrogen and carbon, the excited neutral CNO species, which also has very good reactivity, is also obtained.

In general, oxygen is an additive that can play the part of catalyst in the formation of complex activated species containing at least two elements of the interstitial type.

The gaseous medium containing nitrogen and carbon may also be generated in situ, for example inside the treatment chamber, before or simultaneously with the formation of the activated species used within the scope of the invention.

It is possible, for example, to introduce into the treatment chamber a gaseous mixture containing only nitrogen and optionally a dilution gas, such as hydrogen and/or argon. The carbon is introduced into the chamber in the form of a target of solid carbon, for example of graphite or of a solid element containing carbon. Inside the treatment chamber (or in a plasma generator separate from the chamber), the target is subjected to a beam of ions which is produced from the gaseous mixture based on nitrogen. The target could also be bombarded with any other incident particle beam independent of the plasma formed from the gaseous medium containing nitrogen. The bombardment of the target results in a pulverisation of the carbon and an emission of the element carbon in the gaseous medium or the plasma formed from the gaseous medium. In any case, energy has to be communicated to the gaseous medium or to the plasma to obtain a combination of carbon and nitrogen in the form of activated species and, in particular, in the form of excited neutral species of the CN form.

In general, a cold plasma generated from a gaseous medium containing carbon and nitrogen, under the conditions of the invention, contains various ionised species and various neutral species which exhibit different behaviour when the treatment of the invention is carried out.

For example, in the case of a gaseous medium constituted by the gaseous mixture $N_2+H_2+CH_4$, the plasma generated, for example, by an electric discharge contains ionised species, such as, for example, $N^+$, $N_2^+$, $CN^+$, $(CN)_2^+$, $C^+$, and excited neutral species, such as N, $N_2$, NH, H, C, CN and $(CN)_2$.

The inventors were able to show that, of all those activated species, the excited neutral species containing carbon and nitrogen and, in particular, the excited neutral CN species, have a very high degree of reactivity, for example, in the case of the surface treatment of an austenitic stainless steel.

In fact, as will be explained hereinafter, the quite exceptional behaviour of the excited neutral CN species, that is to say, of an excited neutral species containing both nitrogen and carbon, means that it is possible to envisage surface treatments under implementation conditions that it has not been possible to envisage hitherto and on parts that could not be treated by treatment methods using ionised species.

By way of example, a description will now be given, with reference to the appended Figures, of a particular implementation of the invention for carrying out a hardening treatment on austenitic stainless steel parts.

As indicated above, in the case of the treatment of austenitic stainless steel parts, it is preferable to carry out a treatment while maintaining the part(s) to be treated at a temperature lower than a temperature level at which precipitates of nitrides or carbides begin to appear in the metal matrix of the surface layer of the parts which is enriched with nitrogen and carbon by the surface treatment.

Although, in general, the treatment for hardening austenitic stainless steel parts by means of nitrogen and carbon can be carried out at a temperature of from 200° C. to 600° C., in order to prevent the formation of precipitates, it is recommended to treat the parts in a temperature range of from 300° C. to 480° C. and preferably from 300° C. to 460° C.

As shown in FIG. 1, the treatment installation is constituted by a chamber of a furnace 1, for example produced in two portions 1*a* and 1*b* which can be separated from one another in order to charge the furnace and which can be joined to one another with the interposition of seals, in such a manner that the chamber 2 of the furnace is practically gas-tight, in order to prevent air entering the furnace during treatment.

The chamber of the furnace can be evacuated and filled with a gaseous mixture, such as $N_2+H_2+CH_4$, for example by means of an evacuation tube 3' and a filling tube 3.

The chamber 1 of the treatment furnace contains a support 4 on which parts to be treated 5 can be arranged.

As will be explained hereinafter, when the method of the invention is implemented, it is advantageously possible to arrange on the support 4 one or more non-sealed containers accommodating the parts to be treated.

The support 4 is connected to a cathode terminal of an electric generator 6, of which the second terminal, or anode terminal, is connected electrically to the chamber of the furnace 1.

The support 4 and the parts or containers 5 arranged on the support 4 are thus brought to a cathode potential compared with the chamber 1 which is at an anode potential.

After evacuating the chamber 2 of the furnace 1 and filling it with a gaseous mixture of $N_2+H_2+CH_4$, at a pressure lower than 100 mbar, the generator 6 is set in operation to create an abnormal luminescent discharge between the cathode constituted by the containers 5 and the wall 1 of the treatment furnace.

A plasma is generated around the containers 5, in the luminescent discharge.

The discharge is controlled in such a manner as to produce activated species in the gaseous mixture and, in particular, the excited neutral CN species, which are characteristic of the implementation of the method of the invention in a gaseous mixture containing carbon and nitrogen.

The parts are also heated and their temperature is regulated throughout the duration of the treatment, as described hereinafter.

Throughout the treatment, the gases contained in the chamber 2 are also continuously renewed in order to regulate the pressure inside the chamber 2 and to provide a constant supply of the nitrogen and carbon which are required to generate the activated species used during the treatment.

An extremely important feature of the method according to the invention is obtained owing to the exceptional reactivity of the excited neutral species containing carbon and nitrogen and in particular of the excited neutral CN species, this excited neutral species preserving its reactivity even after passing through a space that does not allow a plasma to be ignited.

In plasma technology, it is known that a plasma cannot be propagated through an interstice whose opening dimension is smaller than a length called the Debye length which depends in particular on the nature and the pressure of the gaseous medium of the plasma.

In the case of the gaseous mixture and the pressure mentioned above, the Debye length is of the order of a few tenths of a millimetre.

It is therefore not possible to ignite a plasma in a portion of a part or in the inner space of a container which is separated from the discharge region in the treatment chamber by an opening of a minimum size, for example of a width, smaller than a few tenths of a millimetre.

The inventors have observed that, extremely surprisingly, in the case of a plasma obtained from a gaseous mixture containing both carbon and nitrogen, the surface treatment is effected on surfaces that are not exposed to the plasma and that are separated from the region subjected to the plasma by an interstice having an opening of a size that does not enable a plasma to be ignited.

The inventors were able to demonstrate that this effect is due to the quite exceptional and lasting reactivity of activated species comprising both carbon and nitrogen and, in particular, of the excited neutral CN species.

On parts not exposed to the plasma, the supply of nitrogen and carbon is effected by the excited neutral CN species, outside the field of the cold plasma.

The inventors also observed that an effect of increasing the activity of plasma is also obtained in the case of plasmas produced by microwaves or radio frequency, in a gaseous medium containing carbon and nitrogen.

Those observations permitted the implementation of a method for treating the surface of parts inside non-sealed containers placed inside the treatment chamber.

Figure 2:
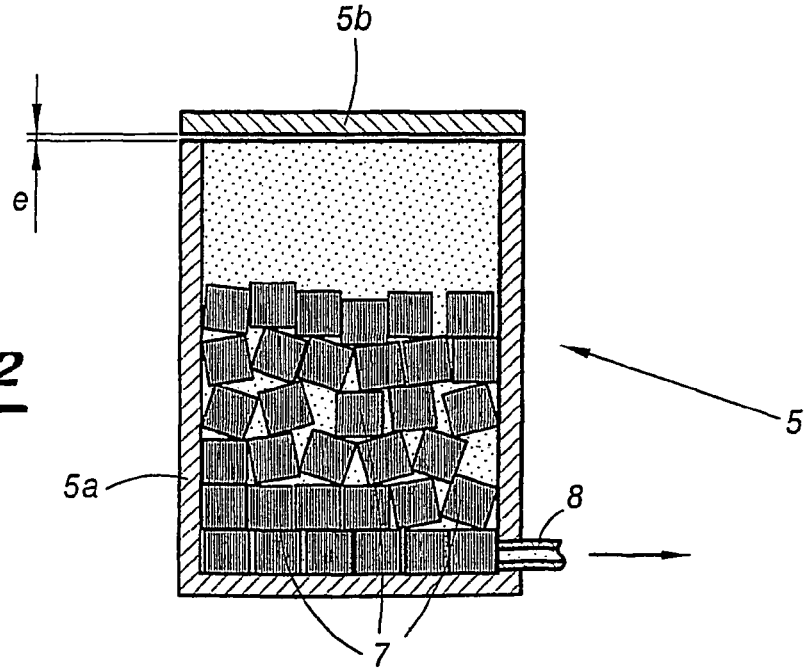
FIG. 2 is a view, in elevation and in section, of a casing or container which can be used for implementing the treatment method according to the invention.

FIG. 2 shows a container 5 comprising a body 5*a*, which is for example, cylindrical and which is closed by a base at a first end and which is open at a second end, and also a lid 5*b* constituted by a simple metal plate placed on the open end of the cylindrical body 5*a* of the container 5. The container 5 is therefore in the form of a simple cylindrical box having a separate flat lid placed on the end edge of the cylindrical body 5*a*.

The container, such as 5, was used to carry out, inside the treatment chamber 2 of the furnace 1, the surface treatment of parts 7 arranged in bulk inside the container. The parts 7 are, for example, so-called "quick-release" couplings of stainless steel 316L.

Advantageously, the body 5*a* and the lid 5*b* of the cylindrical box may be produced from stainless steel 316L. The inner surface of the body 5*a* of the box and optionally of the lid 5*b* may be covered with an insulating material, such as a ceramic.

It was possible to demonstrate that the implementation of the method, that is to say, the surface treatment of the parts 7 inside the container 5, is practically independent of the wall thickness of the box body 5*a*. On the other hand, the treatment of the parts 7 inside the container 5 is possible only if the clearance between the lid 5*b* and the upper edge of the body 5*a* of the casing, when the lid 5*b* is placed on the body 5*a*, is at least equal to a short length of the order of one hundredth of a millimetre.

Instead of a container 5 comprising a solid wall or body 5*a* closed by a lid 5*b* placed on one end of the wall, it is possible to use a container 5 comprising a wall having a plurality of openings inside which closing elements are engaged with a small clearance which does not enable a plasma to be ignited through the openings of the wall. It is also possible to place the container 5 produced in the form of a box, for example a cylindrical box, in an arrangement which is inverted in such a manner that it rests along the edge of its opening on a support ensuring that the box is closed in a non-sealed manner.

In general, the container has at least one opening closed by a closure means which forms, with the edge of the opening, a clearance which is non-zero in the mechanical sense but which is sufficiently large to allow the activated species to pass through and sufficiently small to prevent a plasma from penetrating into the container.

As shown in FIG. 1, one or more casings 5 are arranged on the support 4 and brought to a cathode potential inside the treatment chamber. It is ensured that the residual clearance between the lid 5*b* and the body 5*a* of the containers 5 is smaller than the Debye length. In fact, various experiments are carried out with a variable clearance e, which ranges from one hundredth to three tenths of a millimetre, between the lid 5*b* and the body 5*a* of the containers which is due to the roughness of the surfaces and to a variable bearing or clamping force applied to the lid 5*b*.

In any case, since the opening of the interstice e is considerably smaller than the Debye length, the plasma cannot be ignited inside the container 5 when an electric discharge is produced between the containers 5 and the wall 1 of the furnace.

It was observed that, up to clearances e of the order of one hundredth of a millimetre, the hardening treatment carried out on the parts 7 can be effected inside the container 5. On the other hand, if the lid 5*b* is clamped hermetically against the body 5*a*, the parts 7 are not treated.

Ionised species, such as $N^+$ and $N_2^+$, and excited neutral species, such as N, $N_2$, NH, cannot be in the active state inside the containers because their short lifetime does not permit their transfer between the treatment chamber and the inside of the containers.

Nor can ionised species, such as $C^+$, and excited neutral species, such as C, be in the active state inside the containers, because their short lifetime does not permit their transfer between the treatment chamber and the inside of the containers.

Species containing carbon and nitrogen and, in particular, the excited neutral CN species are in the reactive state inside the container and supply nitrogen and/or carbon to the parts 7, an interstice of a few tenths of a millimetre preventing, for example, the ignition of the plasma while ensuring that the active excited neutral species pass through.

It should be noted that, in the case of the implementation of the invention, a range of opening dimensions of the interstice permitting treatment without contact with the plasma, for example of from 0.01 to 0.3 mm, does not constitute an absolute condition, some values higher than a few tenths of a millimetre preventing, for example, the ignition of the plasma while ensuring that the excited neutral species pass through.

Values lower than 0.01 mm also enable the treatment to be carried out, but with a lower degree of efficiency.

FIG. 2 shows a tube 8 of a container 5 which can be connected to a means for evacuating the gaseous mixture to the outside of the treatment chamber 2 of the furnace. Thus, the introduction of the gaseous mixture containing activated neutral species into the interior of the containers 5 is promoted when such a method of evacuation by way of the containers is used.

The treatment of the parts 7 inside the container(s) 5 is carried out at a temperature enabling a solid solution of at least one of the interstitials carbon and nitrogen to be obtained in a surface layer of the parts, without forming carbide and nitride precipitates in that surface layer.

For that purpose, the treatment is carried out in an atmosphere of methane and nitrogen diluted in hydrogen, at a temperature regulated at around 420° C., that is to say, at a temperature of from 300° C. to 460° C. The treatment is carried out for periods of from 24 hours to 48 hours, depending on the batches of treated parts. Hardened layers of a thickness of from 10 μm to 30 μm are obtained on the parts, those layers having a hardness greater than 1000 Vickers and a resistance to corrosion by a salt spray of greater than 1000 hours.

Treatment is also carried out, inside containers 5, on parts 7 constituted by austenitic stainless steel nuts, the duration of treatment being 18 hours and the temperature being approximately 420° C. The nuts so treated exhibit quite remarkable anti-galling characteristics.

In a general manner, various treatments are carried out on parts made of stainless steel and of chromium-rich steels, the chromium content of which is at least equal to 8% by mass, inside containers placed in the chamber of the furnace containing the gaseous mixture $N_2+H_2+CH_4$.

Before filling the chamber 2 of the furnace 1, after depositing the container(s) 5 on the cathode support and closing the furnace, the furnace is evacuated for a period sufficient to reach a pressure lower than the treatment pressure. The chamber 2 of the furnace 1 is then filled with a mixture of $N_2+H_2+CH_4$ at a pressure lower than 100 mbar. The treatment is carried out for a period of from 1 hour to some tens of hours. The treatment leads to a layer which is hardened by at least one interstitial and which has a thickness of from 1 μm to 500 μm, depending on the duration of the treatment.

Depending on the temperatures to which the austenitic stainless steel parts are heated, the hardened layer is a solid solution of interstitials in the metal matrix of the steel or a solid solution containing carbide and nitride precipitates.

The heating temperature limit for obtaining a solid solution without precipitates is of the order of from 460° C. to 480° C.

It should be noted that, in the case of a treatment in which the plasma is obtained by electric discharge, the containers can also be heated by the electric discharge, the heating of the parts 7 inside the containers being effected by radiation and by conduction through the wall of the containers.

It is possible to provide for supplementary heating of the containers 5 and of the parts 7, for example by electrical resistors, and to regulate heating throughout the treatment.

When the treatment is carried out at a temperature higher than 460° C., the parts may exhibit incipient sensitivity to corrosion owing to the occurrence of nitrides and carbides in the solid solution. Impairment of resistance to corrosion becomes very perceptible from 480° C. From 480° C. to 600° C., corrosion resistance is no longer guaranteed but the part exhibits a very high degree of hardness, which means that some applications of the treatment may be envisaged at temperatures higher than 480° C.

The supplementary heating of the treatment chamber may be effected by means other than heating resistors.

In the case of steels or alloys other than austenitic stainless steels, for example low-alloy or high-alloy construction steels, treatments may be carried out at a temperature of, for example, up to 800° C.

Throughout the treatment, plasma is generated around the containers 5 but, owing to the small width e of the closing interstice of the lid, the plasma cannot be ignited inside the containers when in contact with the parts. The parts are thus protected from any risk of damage by electric arcs.

A surface treatment according to the invention, effected by activated species, such as the excited neutral CN species, without contact with the plasma, therefore has numerous advantages.

In particular, it is possible to treat parts positioned individually or in bulk inside containers, or parts stacked one on top of the other, the contacting surfaces of the parts in the stack being subjected to treatment in the same manner as the visible surfaces, or wound coils whose interstice between the successive turns permits the passage of activated species, such as CN. It is also possible to carry out a surface treatment by means of activated species on the inner surface of very small cavities of metal parts, for example the inner surface of the injection duct of a fuel injector or the inner surface of the ducts of a fuel pipe of a motor vehicle.

In general, when parts are treated with activated species generated by an electric discharge in situ in the treatment furnace according to the method of the invention, the parts are placed inside a container enabling them to be isolated and protected against the risk of electric arcs. The container also permits homogenisation of the temperature of the parts. The temperature of the parts can be regulated in an accurate manner, independently of the production of the activated species.

The invention permits the treatment of parts having very small cavities, for example ducts or slots having a diameter or an opening width of from 0.01 to 0.3 mm, the inner surface of which is hardened by at least one interstitial. Such parts cannot be obtained by conventional plasma nitriding treatment methods and are therefore features of the invention.

The inner surface of the container may be conductive or non-conductive, so that the parts are polarised or non-polarised during treatment. In some cases, the treatment of the parts can be carried out inside containers covered internally by an insulating material, for example by a ceramic.

The strong reactivity of activated species of the CN type enables the method according to the invention to be used to treat very long parts, for example to treat the inner or outer surface of very long tubes.

The invention may be implemented in numerous ways, as regards the nature, the composition and the method of obtaining the gaseous medium which is activated and as regards the method of activating the gaseous medium.

The invention may be applied to the treatment of parts made of numerous materials, for example to the treatment of steels or alloys having a face-centred cubic, body-centred cubic or tetragonal structure, for example austenitic, martensitic, ferritic or austenoferritic stainless steels or any other stainless or non-stainless steel that has a chromium content greater than 8% or any low-alloy or high-alloy construction steel.

The invention is also applicable to other steels and to non-ferrous materials, such as titanium, aluminium and their alloys, or also to alloys of nickel and/or of cobalt.

In the case of austenitic stainless steels, a solid homogeneous solution of carbon and/or nitrogen is produced in the metal alloy, depending on the conditions, in particular the thermal conditions, under which the method is carried out, the content of carbon and nitrogen being higher than 3 atoms % in the hardened surface layer. This content may even reach 50 atoms %. In general, it is preferable for this content to be from 3 atoms % to 30 atoms % in order to obtain good corrosion resistance and good hardening of the steels.

The treatment according to the invention may be applied to a very large number of parts and especially to any mechanical part subjected to wear in a corrosive medium. For example, the invention may be applied advantageously to the production of equipment used in the field of the food industry, the chemical industry, the iron and steel industry, the nuclear industry or the car industry, or to the production of equipment used in a marine environment or in biomedical applications.

The invention has particularly valuable applications in the case of austenitic steels that have to resist scratching, for example stainless steel flats, which may be treated on the starting sheet-metal, before pressing, or in the pressed state and in an arrangement stacked in the treatment chamber.

The parts or objects treated by the method of the invention remain completely lustrous and retain a very attractive appearance after treatment. However, in the case of austenitic stainless steels, in order to retain the lustrous appearance of the parts or objects treated, it is necessary to carry out the treatment at a temperature of at most 480° C.

The invention may be advantageously applied to blades of common objects made of martensitic stainless steel, such as knives or bistouries.

The treatment may be applied to thin sheet-metal in the unwound state or even in the state wound in the form of reels.

The invention may be applied to orthopaedic implants.

The invention may also be applied to valves, to fuel injectors of motor vehicles, to engine rings which can be treated in the stacked state and to turbine parts subject to corrosion by pitting. The invention may be applied to any part, such as a slide valve, a faucet plug, a metal shutter, a tap, a piston, a cylinder, a pump part (centrifugal pump, vane pump, gear pump, lobe pump), a flow regulator part, a pressure regulator part, a solenoid valve part.

The invention may be applied to the rods of control clusters of pressurised water nuclear reactors.

The treatment may be carried out on a strip or on a blank of metal which is used after treatment. The treatment may be carried out on parts arranged individually in a container or disposed in bulk, stacks or coils.

The surface treatment carried out on the metal part by the complex activated species may be, instead of a hardening by interstitials, any other treatment aimed at modifying at least one surface property of the metal part by interaction of the activated species with a surface layer of the part. The surface treatment according to the invention may be carried out even on a passivated surface.

The treatment according to the invention may be used for the surface treatment of non-metal parts, for example parts made of ceramics, glass, rubber, polymer plastics material, the surface properties of which are modified by the action of excited neutral species, such as CN.

The treatment according to the invention may use one or more complex activated species comprising two or more than two elements from among nitrogen, carbon, boron and oxygen. The hardened layer of the parts may comprise one or more interstitials, such as carbon and nitrogen.

The invention claimed is:

1. Method for treating the surface of a part (7), which consists in bringing at least one activated chemical species into contact with a surface of the part (7), characterised in that the activated chemical species is generated in a gaseous medium containing at least two of the elements carbon, nitrogen, boron, and oxygen, so that the activated chemical species is constituted by at least two of the elements carbon, nitrogen, boron, and oxygen, the activated chemical species being generated in the form of an excited neutral species constituted by at least two elements taken from C, N, B, and O by generating a plasma in the gaseous medium inside a treatment chamber (1) and outside a container (5) containing the part to be treated communicating with the treatment chamber (1) by an interstice whose opening dimension (e) prevents plasma ignition through the interstice (e), the species generated by the plasma remaining reactive with respect to the surface of the part (7) after passing into the interstice.

2. Method according to claim 1, characterised in that the gaseous medium comprises, after activation, ionized species, and excited neutral species, taken from N, $N_2$, NH, C, H, CN and $(CN)_2$.

3. Method according to claim 1, characterised in that a plasma is generated in the gaseous medium by either electric discharge or electromagnetic wave, in the treatment chamber (1), but outside the container (5). containing the part to be treated (7).

4. Method according to claim 1 characterised in that the interstice has an opening dimension of from 0.01 mm to 0.3 mm.

5. Method according to claim 1, characterised in that a plurality of parts (7) are placed in the container (5).

6. Method according to claim 1, characterised in that the gaseous medium comprises principally carbon and nitrogen, and in that the carbon and the nitrogen are present in the gaseous medium in the form of a compound whose molecule contains both the element carbon and the element nitrogen.

7. Method according to claim 1, characterised in that the gaseous medium contains principally carbon and nitrogen and is obtained by bombarding a target of carbon with a beam of particles, in the presence of a gas containing nitrogen.

8. Method according to claim 1, characterised in that the part is of metal and is made of one of the following materials: low-alloy or high-alloy construction steel, austenitic, martensitic, ferritic or austeno-ferritic stainless steel, steel having a chromium content higher than 8% by mass, an alloy based on nickel, an alloy based on cobalt, aluminium, an aluminium alloy, titanium, or a titanium alloy.

9. Method according to claim 1, characterised in that the part (7) is arranged inside a container (5) having at least one opening which is closed by a means which forms, with the edge of the opening, a clearance which is non-zero in the mechanical sense but which is sufficiently large to allow the at least one reactive species to pass through and sufficiently small to prevent a plasma from penetrating into the inside of the container (5).

10. Method according to claim 9, characterised in that the container (5) is in the form of a box comprising a wall (5*a*) having at least one opening which is closed in a non-sealed manner by one of the following means: a lid (5*b*) placed on an upper portion of the wall around the opening, a closing means engaged with clearance in the opening or a support on which the inverted box rests, along the edge of the opening.

11. Method according to claim 1, characterised in that the gaseous medium comprises a diluting gas selected from hydrogen and/or an inert gas.

12. Method according to claim 11, characterised in that the gaseous medium is a mixture of $N_2$+$H_2$+$CH_4$.

13. Method according to claim 1, characterised in that the part (7) is of metal and in that the metal part (7) is heated to and maintained at a temperature permitting the diffusion of at least one interstitial element selected from one of the elements carbon, nitrogen, boron and oxygen, which is provided at the surface of the metal part (7) by the at least one activated species, inside a surface layer of the metal part (7).

14. Method according to claim 13, characterised in that the metal part (7) is heated to and maintained at a temperature of from 200° C. to 600° C.

15. Method according to claim 1, characterised in that the plasma is produced by electric discharge.

16. Method according to claim 15, characterised in that the gaseous medium is evacuated to the outside of the treatment chamber (2) from the inside of the container (5).

17. Method according to claim 15, characterised in that the pressure of the gaseous medium is lower than 100 mbar.

* * * * *